US005864519A

United States Patent [19]

Nakamura

[11] Patent Number: 5,864,519

[45] Date of Patent: Jan. 26, 1999

[54] MUSIC BOX TIMEPIECE

[75] Inventor: Norihiko Nakamura, Saitama, Japan

[73] Assignee: Rhythm Watch Co., Ltd., Tokyo, Japan

[21] Appl. No.: 931,241

[22] Filed: Sep. 16, 1997

[30] Foreign Application Priority Data

Dec. 27, 1996 [JP] Japan ..... 8-351675

[51] Int. Cl.[6] ..... G04B 47/00; G04B 21/00; G10F 1/06

[52] U.S. Cl. ..... 368/10; 368/273; 84/2; 84/97

[58] Field of Search ..... 368/10, 75, 272–274; 84/2, 3, 94–100, 106, 111

[56] References Cited

U.S. PATENT DOCUMENTS

| | | | |
|---|---|---|---|
| 2,665,544 | 1/1954 | Rowe et al. | 368/75 |
| 4,349,899 | 9/1982 | Komatsu et al. | 368/75 |
| 4,444,514 | 4/1984 | Grace | 368/273 |
| 5,438,154 | 8/1995 | Segan et al. | 84/600 |

*Primary Examiner*—Vit W. Miska
*Attorney, Agent, or Firm*—Kanesaka & Takeuchi

[57] ABSTRACT

A music box timepiece A having a clock body 10 with a disc music box instrument 20 to which a music box disc 1 is fitted, characterized in that a space 11 in which a spare music box disc 1' can be housed is formed within the clock body, and when the spare music box disc 1' is stored, at least a part of the spare music box disc can be seen from the front.

8 Claims, 9 Drawing Sheets

MUSIC BOX TIMEPIECE

BACKGROUND OF THE INVENTION

1. Field of the Invention

The invention relates to a music box timepiece which has a disc music box instrument on a clock body, wherein a spare music box disc can be housed in the clock body so as to be seen from the front.

2. Description of the Related Art

Generally known sounding means used for a time signal of a timepiece or the like includes a sounding circuit and a loud speaker.

Relatively large ones among desktop and wall clocks these years are often provided with a so-called tricky device that a decoration member such as a puppet operates on the hour, and a music is played in electronic sounds when the decoration member operates on the hour. And, music box sounds are often used for playing.

A timepiece which has electronic sounds to play a music box may be called a music box timepiece (hereinafter referred to as the pseudo-music box timepiece). But, generally, a timepiece which is provided with a mechanical music box instrument is called the music box timepiece, which is known from way back. This music box timepiece plays a predetermined music number and comprises sounding prongs in a strip shape with a plurality of sounding parts corresponding to the musical intervals, a barrel which is disposed to oppose the sounding prongs and provided with pins protruded to pluck the sounding parts of the sounding prongs with predetermined playing timing, and a drive unit for rotating the barrel at a predetermined speed.

As described above, the music box timepiece uses the barrel, needing a breadth for the barrel. Therefore, the timepiece becomes large.

On the other hand, the pseudo-music box timepiece does not have such a disadvantage, but lacks in realism or presence of the music box play. However, there is proposed to rotate a circular plate formed like a music box disc or to dispose a miniature of the music box, thereby creating an atmosphere of the music box timepiece.

In connection with the music box instrument itself, there is proposed a music box which can play a given music number by configuring to use a circular music box disc having the pattern for a predetermined music number and to change such a music box disc.

This music box disc is formed into a circular plate, one surface of the disc is divided into a plurality of tracks corresponding to music box petals of a music box sounding member, and engaging parts for playing are formed at positions in the circumferential direction corresponding to the timing of playing musical scales shared by the respective tracks. And, these engaging parts for playing are made of projections protruded from one surface of the music box disc or holes having a predetermined diameter. And, predetermined parts of the sounding member are plucked by these engaging parts for playing.

This type of disc music box is easy to handle the music box disc, so that the disc can be easily fitted or removed and changed in a short time. Therefore, when a plurality of music box discs for different music numbers are provided in advance, a desired music number is selected from these music box discs and the music box disc is changed, so that a music number to be played by the music box can be changed quickly and with ease. Thus, the disc music box is easy to mount a desired music box disc by selecting from a plurality of music box discs as compared with the music box provided with a stationary barrel for a single music only. It has an advantage that music numbers can be changed flexibly and easily.

Accordingly, the inventor studied a music box timepiece having a timepiece provided with a disc music box instrument. And, there was a problem of where the music box disc are stored.

Specifically, the music box using a disc has an advantage that the music box disc can be changed as described above. Therefore, the music box timepiece is also advantageous to use a plurality of music box discs.

For example, equipment such as a CD (compact disc) player which has a plurality of discs used exchangeably stores often the discs in a separately disposed storage. But, the music box timepiece uses a few music box discs and is rare to use dozens of them. Therefore, a special storage is not disposed, but an appropriate cabinet is used for storing them. And, it is apprehended that the stored music box discs are forgotten where they were stored and not used after all.

SUMMARY OF THE INVENTION

Accordingly, it is an object of the invention to provide a music box timepiece which can store a plurality of music box discs rationally when they are used.

According to one aspect of the invention there is provided a music box timepiece having a clock body with a disc music box instrument to which a music box disc is fitted, characterized in that a space in which a spare music box disc can be housed is formed within the clock body, and when the spare music box disc is stored, at least a part of the spare music box disc can be seen from the front.

The spare music box disc is basically stored in the space of the clock body. Therefore, it is not necessary to dispose separately a member or storage to store the spare music box disc outside of the timepiece. And, when the spare music box disc is stored in the space, a part of the spare music box disc is seen from the front, so that the presence of the spare music box disc can be checked, its loss can be prevented, and a look of the music box timepiece can be improved by providing the appearance of a plurality of music box discs existing.

According to another aspect of the invention there is provided a music box timepiece wherein the spare music box disc is stored around the music box disc fitted to the disc music box instrument.

Thus, since the spare music box disc is stored around the music box disc fitted to the disc music box instrument, additional ornamentation can be given, and the music box disc can be changed quickly, thus improving convenience.

According to still another aspect of the invention there is provided a music box timepiece wherein the space is disposed on the side back and around the music box disc fitted to the disc music box instrument, and the music box disc and the spare music box disc are disposed to partly overlap when seen from the front.

Therefore, ornamentation of the music box disc rotatably driven is not deteriorated, and the timepiece can be made small.

According to yet another aspect of the invention there is provided a music box timepiece wherein a spare music box disc holder to which the spare music box disc can be fitted removably is disposed in the space. Therefore, the spare music box disc can be fixed securely.

BRIEF DESCRIPTION OF THE DRAWINGS

FIG. 4(2) is a perspective view showing a state that the incision is pushed and erected;

FIG. 4(3) is a perspective view showing a state that the erected part is folded double as projection;

FIG. 7(2) shows an initial state that a pick of the star wheel is engaged with a playing engaging part of the music box disc;

FIG. 7(3) shows a state that a music box petal is plucked by a pick of the star wheel to produce a sound;

FIG. 7(4) shows a state restored to be ready to produce a sound;

DESCRIPTION OF THE PREFERRED EMBODIMENT

Figure 1:
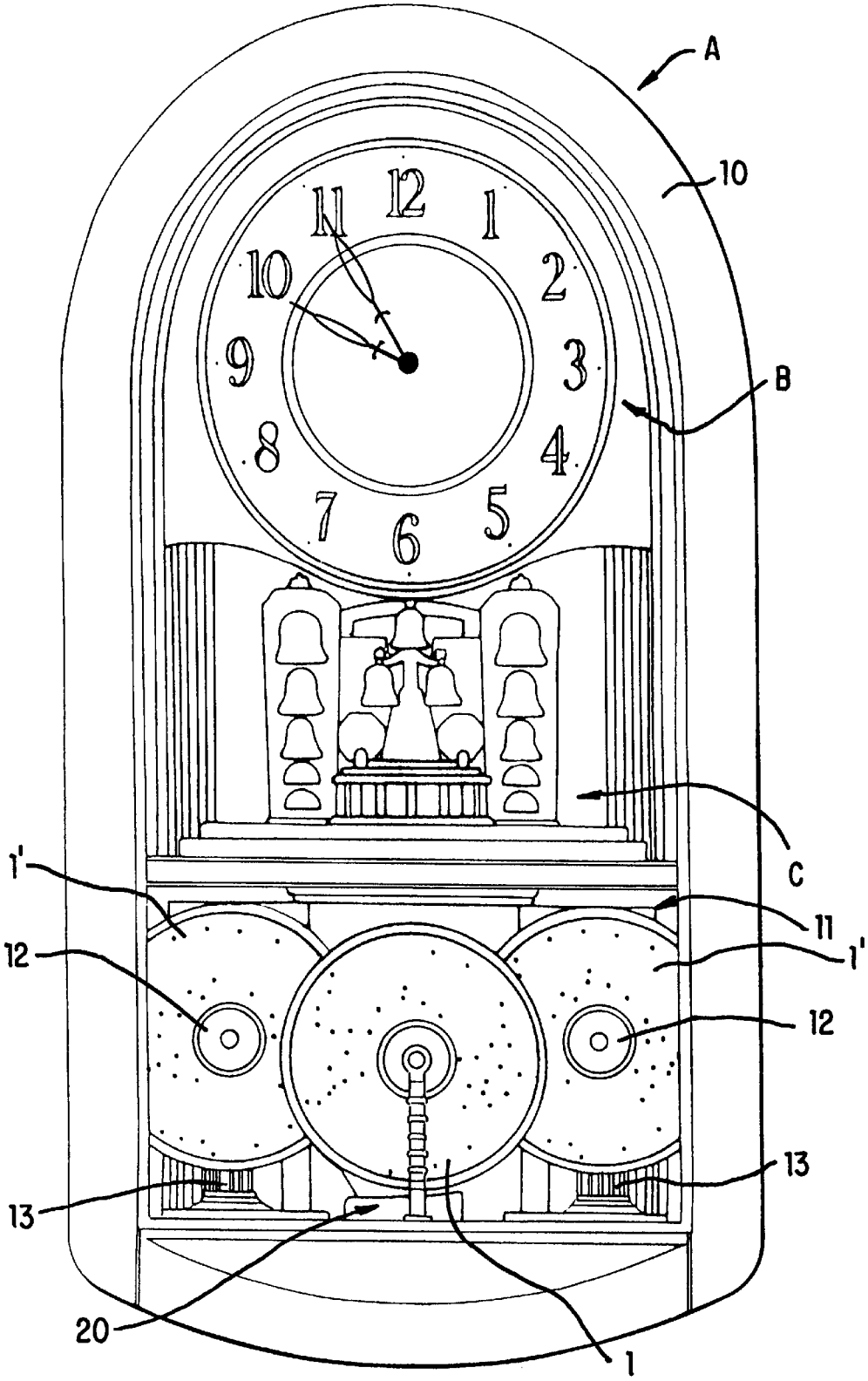
FIG. 1 is a front view of a timepiece practicing the invention.

In FIG. 1, a music box timepiece A of this embodiment has a disc music box instrument 20 to which a music box disc 1 is fitted within a clock body 10. This music box timepiece A also has within the clock body 10 a space 11 in which spare music box discs 1', 1' can be accommodated vertically, and music disc holders 12, 12 are disposed in this space 11. In this embodiment, the disc music box instrument 20 is disposed at a position just below the front of the clock body 10 and seen from outside, and the music box disc 1 is vertically fitted to the music box instrument 20. Besides, as described afterwards, a pair of music box holders 12, 12 are disposed at the back and right and left of the vertically fitted music box disc 1, and spare music box discs 1', 1' are removably fitted to the music box disc holders 12, 12. When the spare music box discs 1', 1' are fitted to the music disc holders 12, 12, at least a part of the spare music box discs can be seen from outside.

Figure 2:
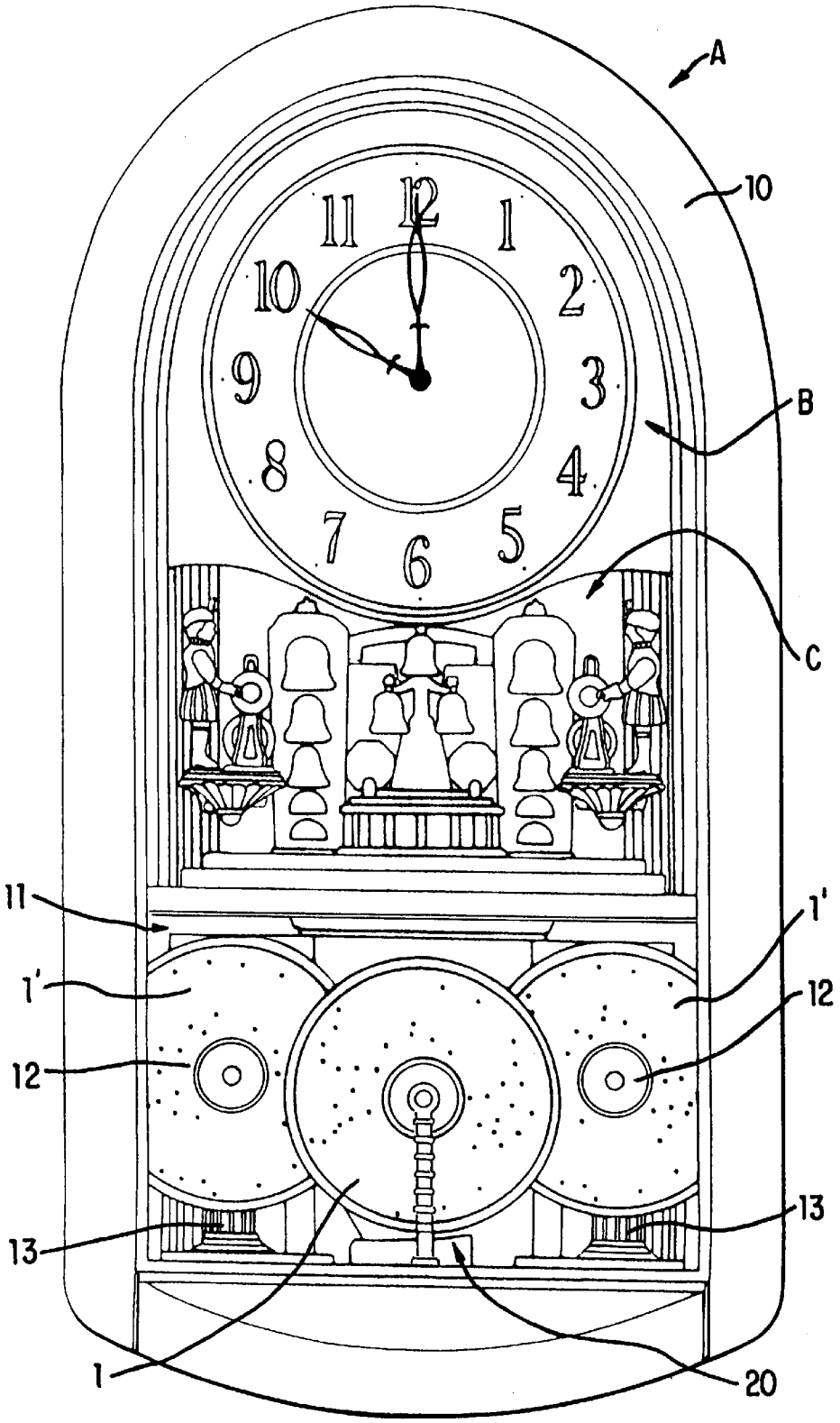
FIG. 2 is a front view of a timepiece practicing the invention.
Figure 3:
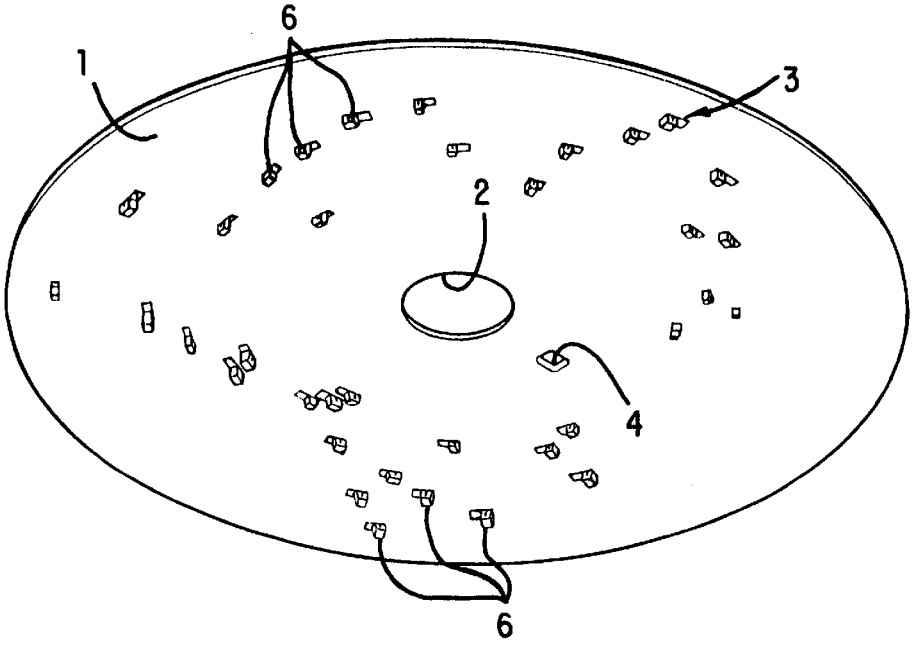
FIG. 3 is a perspective view showing a schematic entire structure of the music box disc of the embodiment with the playing engaging parts formed on its back surface seen from below.

The music box timepiece A shown in FIG. 1 has a tricky device C between a timepiece unit B which has a dial plate and clock hands and the disc music box instrument 20. And, in this case, as shown in FIG. 2, a puppet of the tricky device C lowers to appear at the front on the hour, the disc music box instrument 20 operates to rotate the music box disc 1 to play the music box.

The music box discs 1, 1' are made of light metal such as an aluminum material or the like and formed into a circular plate, and its back side is divided into a plurality of tracks corresponding to the music box petals 27*a* of the music box sounding member 27 of the music box instrument 20, and the engaging parts 3, 3 for playing are formed at positions in the circumferential direction corresponding to the timing of playing musical scales shared by the respective tracks. Reference numeral 4 in the drawing denotes a drive hole which is used to drive to rotate the disc.

Figure 4:
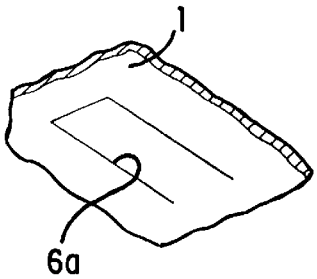
FIG. 4(1) is a perspective view showing a state that an incision is made on the music box disc.
Figure 4:
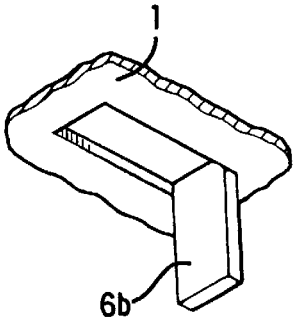
Figure 4:
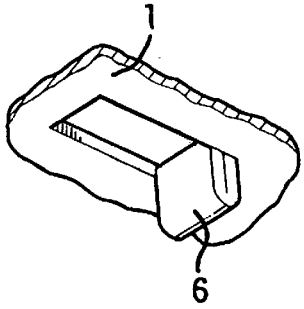

And, the engaging part 3 for playing is a protruded type. By cutting in at an appropriate part of the metal music box disc and erecting, projections 6 are formed, and the projections 6 are used as the playing engaging parts 3 to produce sounds. Specifically, as shown FIG. 4, rectangular U-shaped incision 6*a* is formed (FIG. 4 (1)), this incision 6*a* is pushed and erected as an erected part 6*b* (FIG. 4 (2)), and the erected part 6*b* is folded at its middle to form the projection 6 which protrudes to a predetermined height from the back face of the music box disc (FIG. 4 (3)). Since the playing engaging parts 3 are formed as described above, the music box discs 1 can be produced by means of simple production jigs and production process.

Figure 5:
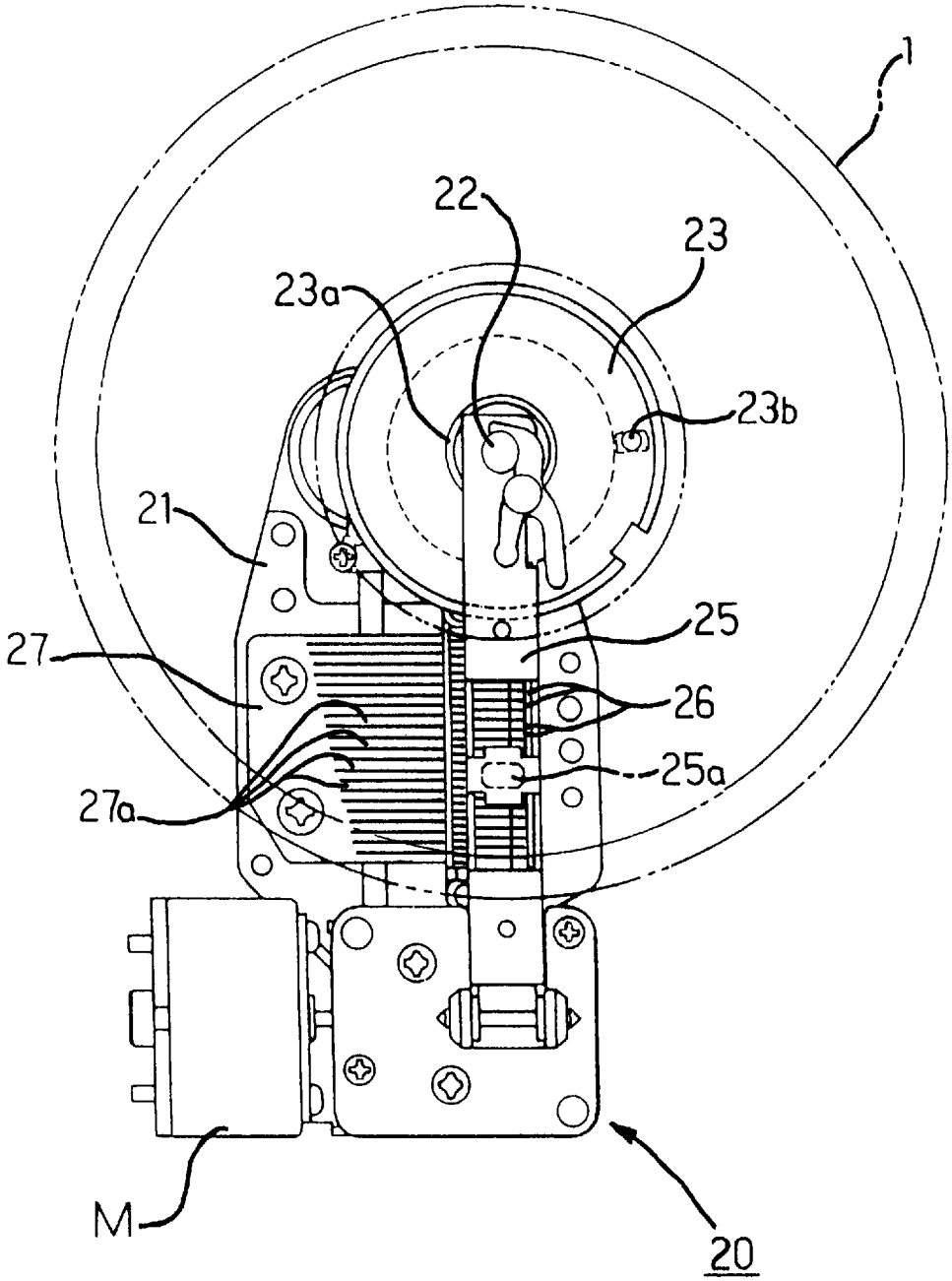
FIG. 5 is a front view showing the disc music box instrument using the music box disc of the embodiment.
Figure 6:
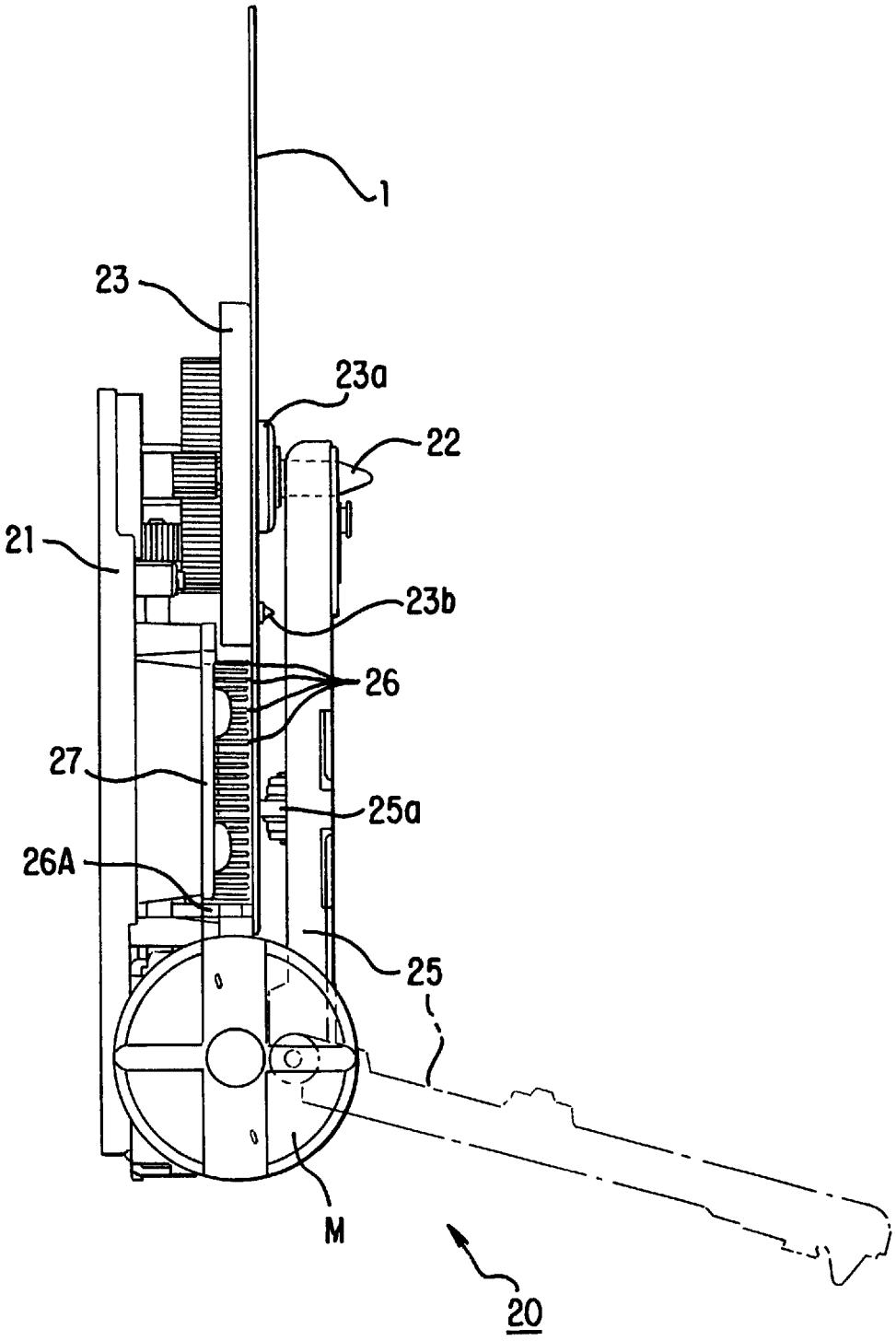
FIG. 6 is a side view of the same disc music box instrument.

And, the music box disc 1 is configured to play the music box by the disc music box instrument 20 shown in FIG. 5 and FIG. 6.

Specifically, the disc music box instrument 20 comprises a base 21 which is formed in a substantially flat plate shape, a disc fitting member 23 which is rotatably fitted with play to a support shaft 22 which is set up on the base 21, a holding arm 25 which detachably holds the music box disc 1 on the fitting member 23, a disc drive mechanism which drives to rotate the fitted music box disc 1, and a music box sounding member 27 which is driven to sound by the respective playing engaging parts 3 of the music box disc 1 to be driven to rotate through the corresponding star wheels 26.

The disc fitting member 23 is made of a synthetic resin in the form of a thick circular plate, and fitted with play to the metal support shaft 22 which is set up on the base 21. And, this disc fitting member 23 has a fitting part 23*a* having an outer diameter corresponding to the inner diameter (a fitting hole 2) of the music box disc 1 formed and also has a drive projection 23*d* projected at the position of a radius corresponding to the drive hole 4 of the music box disc 1.

The disc fitting member 23 is connected to the output gear of a speed reduction and transmission mechanism of a disc drive mechanism (not shown), and driven to rotate at a predetermined speed by reducing to a predetermined speed and transmitting the rotational drive force of the motor M fixed to the exterior of the disc radius of the base 21.

Besides, the holding arm 25 is formed into substantially a long plate which is longer than at least the radius of the music box disc 1, its base end is pivotally mounted on the base 21, and its leading end is formed to be engageable with the support shaft 22 vertically mounted on the base 21. Therefore, the user can change the music box disc 1 quickly and easily by standing the holding arm 25, and regardless of the posture of the base 21, the music box disc 1 can be held stably to play the music box.

Besides, the music box sounding member 27 which operates to produce the music box sounds is made of a metal material to have long strips and disposed on the base 21 to be parallel to the music box disc 1. Specifically, a leading end at one end of the music box sounding member 27 is fixed with the music box petals 27*a* formed in the shape of comb teeth, and the ends of the music box petals 27*a* are disposed to correspond to the radius direction of the music box disc 1 corresponding to the holding arm 25, and the base end of the other end is fixed to the seating of the base 21. The respective music box petals 27*a*, 27*a* are formed in a predetermined number corresponding to the number of musical scales to be sounded and to have predetermined thickness and lengths corresponding to the musical scales; and when the tips of the music box petals 27*a,* 27*a* are plucked, music box sounds with predetermined musical scales/musical intervals are produced.

And, the plurality of star wheels 26 corresponding to the number of musical scale tracks of the music box disc 1 are rotatably supported by the star wheel shaft 26A at the position on the side of the lower surface of the music box disc 1 with respect to the holding arm 25. And, an interval holding member (not shown) is disposed on the base 21, and the respective star wheels 26 are retained to oppose the music box petals 27*a* of the music box sounding member 27.

After the music box disc 1 selected as desired is fitted to the music box instrument 20, a monitor switch (not shown) is turned, the music box disc 1 is driven to rotate by the disc drive mechanism, and the music box petals 27*a* corresponding to the musical scales of a music number are plucked by the picks 26*a* of the star wheels 26 with predetermined timing to play the music box.

Specifically, the projections 6 of the respective engaging parts 3 for playing of the music box disc 1 catch the picks 26*a* of the star wheels 26 corresponding to the engaging parts 3 for playing to force the star wheels 26 rotate, and the music box petals 27*a* are finally plucked by the subsequent other picks 26*a* of the rotating star wheels 26 to produce the music box sounds.

Figure 7:
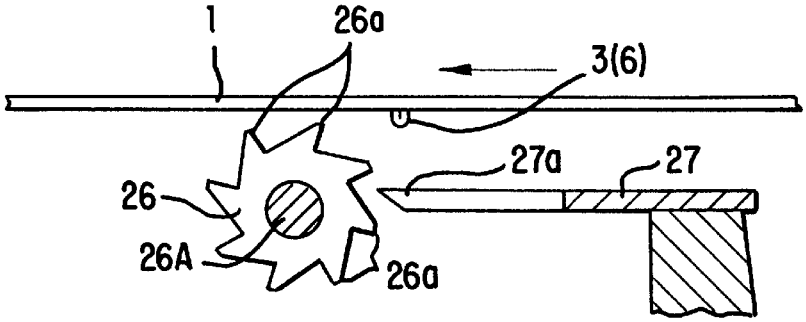
FIG. 7(1) shows a state ready to produce a sound.
Figure 7:
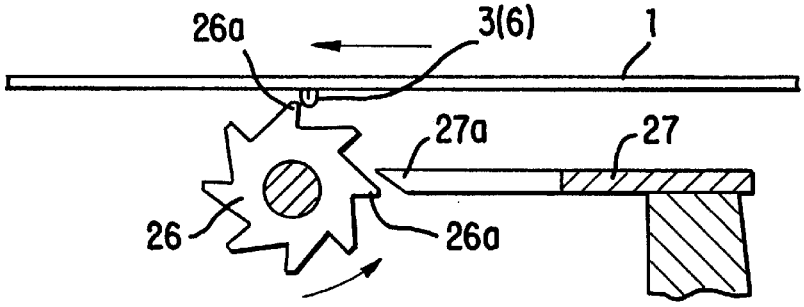
Figure 7:
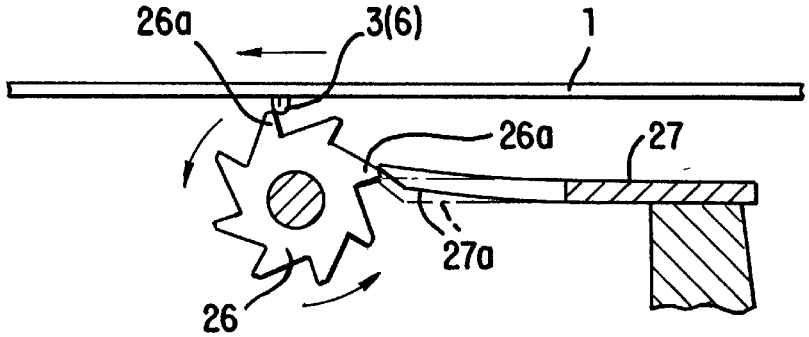
Figure 7:
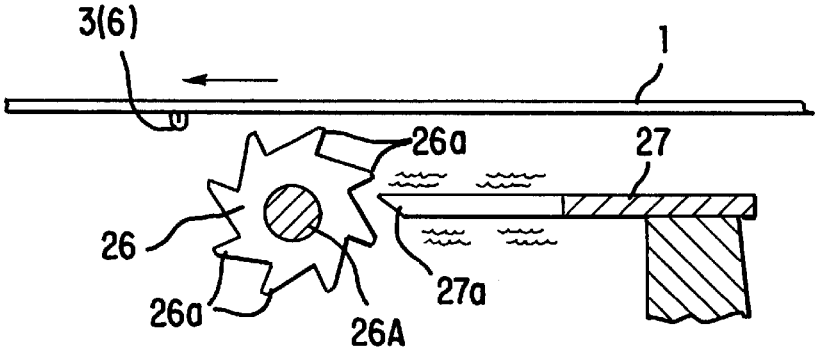

As shown in FIG. 7, the music box disc 1 is driven to rotate (FIG. 7 (1)), the playing engaging part 3 is engaged with, for example, the pick 26*a,* among the picks 26*a* of the star wheel 26 (FIG. 7 (2)), the pick 26*a* is forced to move by the projection 6 of the engaging part 3, and the star wheel 26 is rotated. At the same time, the pick 26*a* subsequent to the pick 26*a* of the star wheel 26 comes in contact with the music box petal 27*a* (FIG. 7 (3)) and further moves to pluck the music box petal 27*a* (FIG. 7 (4)). As a result, the music box sound particular to the music box petal 27*a* is produced.

Figure 8:
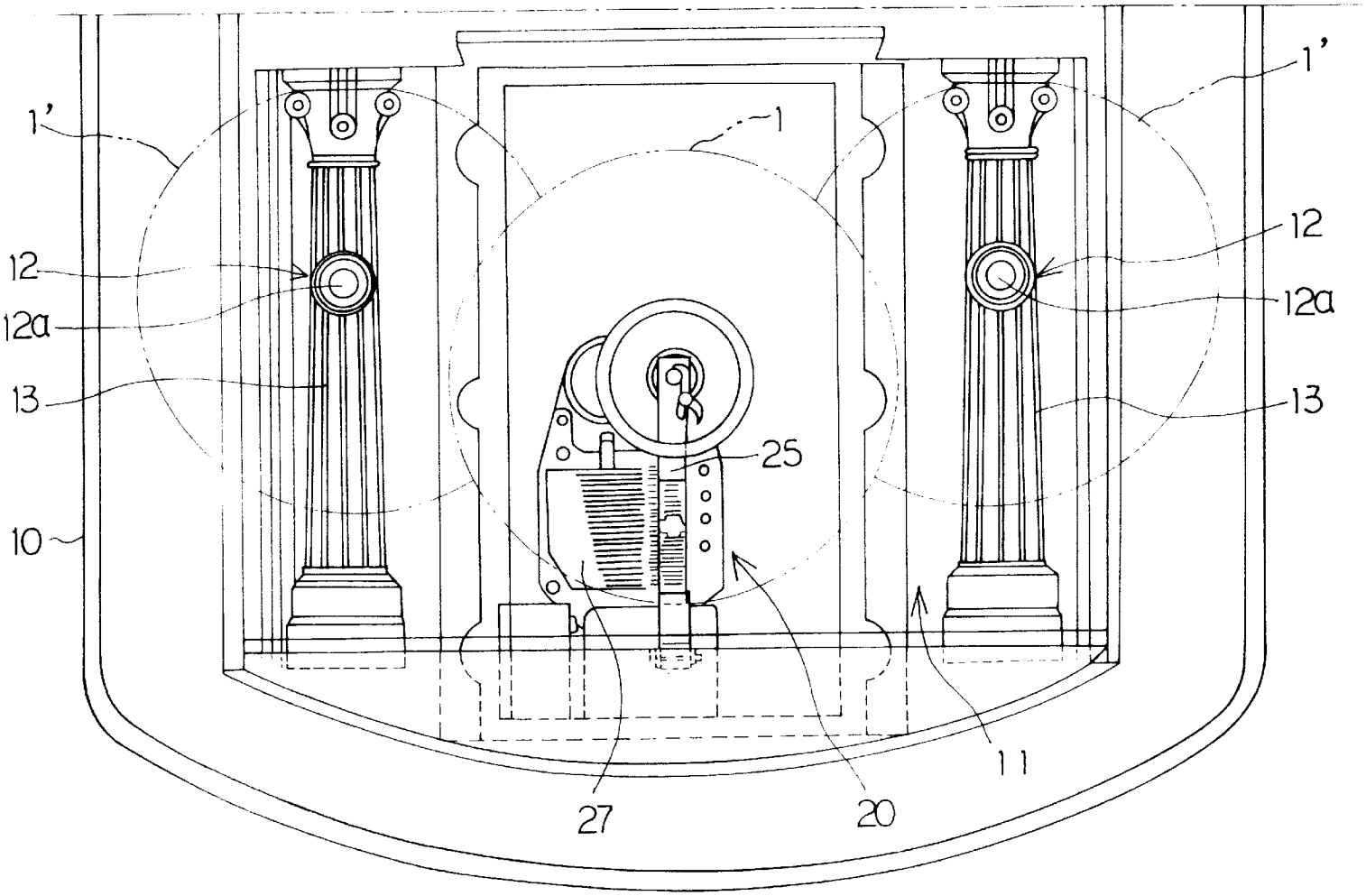
FIG. 8 is a front view showing the music box disc holders of the music box timepiece of the embodiment.
Figure 9:
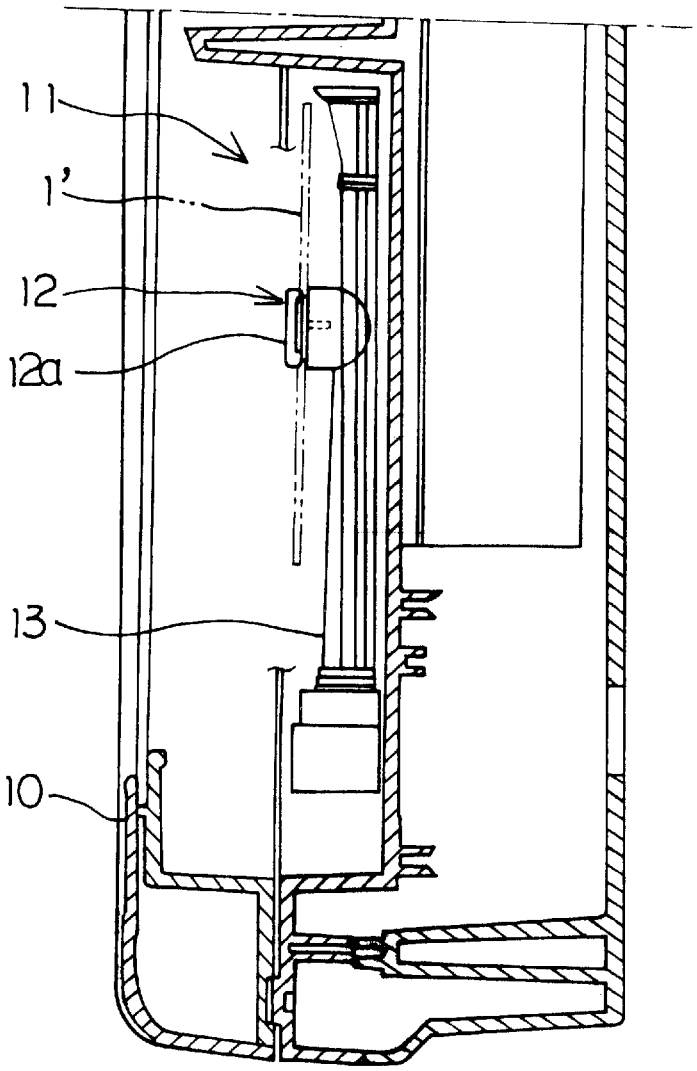
FIG. 9 is a vertical sectional view showing the music box disc holders of the music box timepiece of the embodiment.
Figure 10:
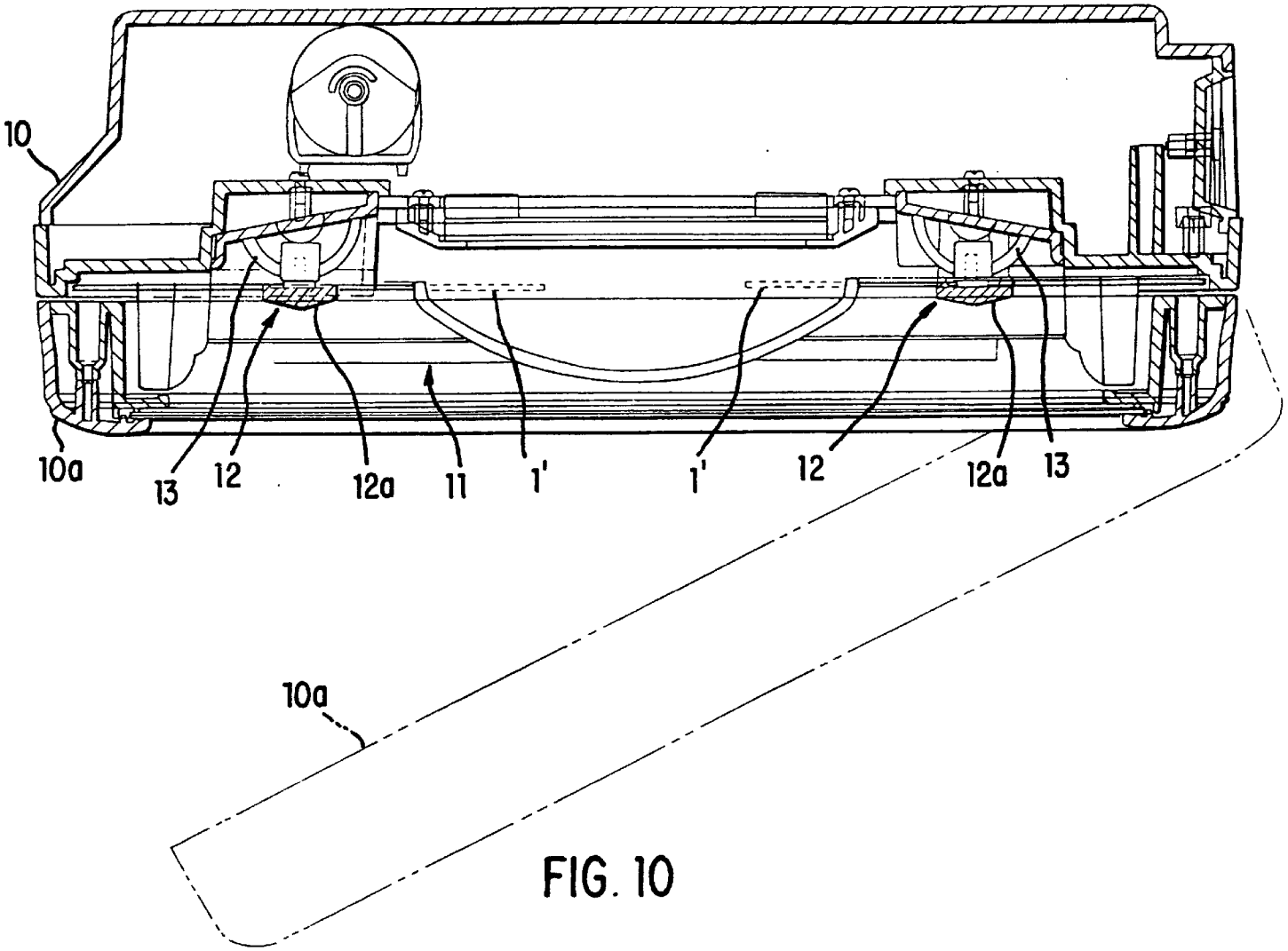
FIG. 10 is a transverse sectional view showing the music box disc holders of the music box timepiece of the embodiment.

The music box timepiece A of this embodiment having the disc music box instrument 20 has within the clock body 10 the space 11 in which the spare music box discs 1', 1' can be accommodated vertically, and the music disc holders 12, 12 are disposed in this space 11 as shown in FIG. 8 to FIG. 10.

The music box disc holders 12, 12 are disposed in pair at the back and right and left of the music box disc 1. In this embodiment, columns 13, 13 are disposed on both sides of the space 11, these columns 13, 13 are employed to direct the appearance of supporting the tricky equipment C, and the music box disc holders 12, 12 are disposed on the left and right columns 13, 13 at their upper part and front sides. The respective holders 12 have a fitting part 12*a* having an outer diameter corresponding to the fitting hole of the spare music box disc 1'. The fitting part 12*a* is threaded to the column 13 in this embodiment. And, the spare music box discs 1', 1' are removable fitted to the music box disc holders 12, 12. And, when the spare music box discs 1', 1' are fitted to the music box disc holders 12, 12, the center parts of these music box discs can be seen from outside.

And, to change the music box disc 1 fitted to the disc music box instrument 20, a front housing 10*a* of the clock body 10 is opened as indicated by the two-dot chain line of FIG. 10, and the music box disc 1 is exchanged with the spare music box disc 1'. The front housing 10*a* is openably disposed by hinges (not shown).

As described above, the music box timepiece of this embodiment has the disc music box instrument disposed at a position just below the front of the clock body and seen from outside, and the music box disc is vertically fitted to the music box instrument. The pair of music box disc holders are disposed at the back and right and left of the vertically fitted music box disc, and the spare music box discs are removably fitted to the music box disc holders. Therefore, since the disc music box instrument disposed at a position just below the front of the clock body and seen from outside, the operation of the instrument on the hour can be seen from outside, and the appearance of the music box timepiece can be improved further. And, since the music box disc is vertically fitted to the disc music box instrument, the music box disc can have its surface directed the front, and even if the clock body is narrow in its lengthwise direction, the disc music box instrument can be disposed. Besides, since the pair of music box disc holders are disposed at the back and right and left of the music box disc and the spare music box discs are vertically fitted to these music box disc holders, the music box discs are disposed in good balance, and a small space can be utilized efficiently.

In the embodiment described above, it was described that the music box disc is vertically fitted to the disc music box instrument and the spare music box discs are vertically disposed, but the invention is not limited to it and the music box disc may be disposed slantwise. Besides, in addition to fitting to the holders, the spare music box discs may be housed in an appropriate storage. If the space of the clock body has a clearance, the spare music box disc may be disposed appropriately to be straight horizontally with respect to the music box disc.

As described above, according to one aspect of the invention there is provided a music box timepiece having a clock body with a disc music box instrument to which a music box disc is fitted, characterized in that a space in which a spare music box disc can be housed is formed within the clock body, and when the spare music box disc is stored, at least a part of the spare music box disc can be seen from the front.

The spare music box disc is basically stored in the space of the clock body. Therefore, it is not necessary to dispose separately a member or storage to store the spare music box disc outside of the timepiece. And, when the spare music box disc is stored in the space, a part of the spare music box disc is seen from the front, so that the presence of the spare music box disc can be checked, its loss can be prevented, and a look of the music box timepiece can be improved by providing the appearance of a plurality of music box discs existing.

According to another aspect of the invention there is provided a music box timepiece wherein the spare music box disc is stored around the music box disc fitted to the disc music box instrument.

Thus, since the spare music box disc is stored around the music box disc fitted to the disc music box instrument, additional ornamentation can be given, and the music box disc can be changed quickly, thus improving convenience.

According to still another aspect of the invention there is provided a music box timepiece wherein the space is disposed on the side back and around the music box disc fitted to the disc music box instrument, and the music box disc and the spare music box disc are disposed to partly overlap when seen from the front.

Therefore, ornamentation of the music box disc rotatably driven is not deteriorated, and the timepiece can be made small.

According to yet another aspect of the invention there is provided a music box timepiece wherein a spare music box disc holder to which the spare music box disc can be fitted removably is disposed in the space.

Therefore, the spare music box disc can be fixed securely. Thus, the invention provides a music box timepiece which can store a plurality of music box discs rationally when they are used.

What is claimed is:

1. A music box timepiece having a clock body with a disc music box instrument to which a music box disc is fitted, characterized in that a space in which a spare music box disc can be housed is formed within the clock body, and when the spare music box disc is stored, at least a part of the spare music box disc can be seen from the front.

2. The music box timepiece as set forth in claim 1, wherein the spare music box disc is stored around the music box disc fitted to the disc music box instrument.

3. The music box timepiece as set forth in claim 1, wherein the space is disposed on the side back and around the music box disc fitted to the disc music box instrument, and the music box disc and the spare music box disc are disposed to partly overlap when seen from the front.

4. The music box timepiece as set forth in claim 2, wherein the space is disposed on the side, back and around the music box disc fitted to the disc music box instrument, and the music box disc and the spare music box disc are disposed to partly overlap when seen from the front.

5. The music box timepiece as set forth in claims 1, wherein a spare music box disc holder to which the spare music box disc can be fitted removably is disposed in the space.

6. The music box timepiece as set forth in claims 2, wherein a spare music box disc holder to which the spare music box disc can be fitted removably is disposed in the space.

7. The music box timepiece as set forth in claims 3, wherein a spare music box disc holder to which the spare music box disc can be fitted removably is disposed in the space.

8. The music box timepiece as set forth in claims 4, wherein a spare music box disc holder to which the spare music box disc can be fitted removably is disposed in the space.

* * * * *